United States Patent [19]

Parker et al.

[11] 4,281,801

[45] Aug. 4, 1981

[54] GRANULATOR WITH FALSE BOTTOM COLLECTION CHAMBER

[76] Inventors: Frank Parker; Leslie M. Parker, both of Old Brandon Rd., Hillsboro, Tex. 76645

[21] Appl. No.: 91,358

[22] Filed: Nov. 5, 1979

[51] Int. Cl.[3] ..... B02C 18/22

[52] U.S. Cl. ..... 241/222; 241/60

[58] Field of Search ..... 241/101.7, 57, 60, 73, 241/186 R, 186.2, 186.3, 222, 224; 406/139, 145

[56] References Cited

U.S. PATENT DOCUMENTS

| | | | |
|---|---|---|---|
| 2,162,490 | 12/1939 | Koranda et al. | 406/145 |
| 2,800,286 | 7/1957 | Bryant | 241/186 R X |
| 3,378,210 | 4/1968 | Bambach | 241/73 X |
| 3,627,211 | 12/1971 | Leach | 241/73 X |

*Primary Examiner*—Eugene F. Desmond
*Attorney, Agent, or Firm*—James E. Bradley

[57] ABSTRACT

A device for granulating objects into particles has a false bottom for improving collection of particles. The device includes a housing with a cutter assembly located in the housing for granulating the objects into particles. A blower is connected to the housing for removing the particles from the housing. The false bottom consists of a downwardly facing channel carried between the cutter assembly and the bottom of the housing. Spaces exist between the bottom of the housing and the edges of the channel for the admission of particles to the space below the channel. The blower is connected to one end to create air movement through the channel for removing the particles.

8 Claims, 2 Drawing Figures

GRANULATOR WITH FALSE BOTTOM COLLECTION CHAMBER

BACKGROUND OF THE INVENTION

1. Field of the Invention

This invention relates in general to machinery for comminuting scrap articles, particularly plastic articles, and in particular to an improved means for removing the particles from the granulator.

2. Description of the Prior Art

In manufacturing plastic articles, a large amount of scrap is generated. This may be due to defects in the completed articles, or in the case of die stamping of sheet material, the scrap may be excess sheet material. To conserve material costs, the scrap may be fed into a granulator that reduces the scrap to small particles. These particles are melted and reused.

Many granulators have blowers or fans for creating a suction to draw the particles out continuously as they are generated. High capacity blowers, however, create considerable noise, that can be reduced by sound proofing only to a limited extent. The cutter assembly and its electrical motor also generates appreciable noise. Environmental regulations limit the maximum sound level of the machinery. Consequently, it is desired to have the smallest blower possible both for this reason and to reduce energy costs.

Noise and particle removal is particularly a problem with low profile granulators that are located below presses. Because of space limitations, there is little room for storing particles in the granulator as they are cut. Consequently if a smaller blower is to be utilized, the collection efficiency must be improved.

SUMMARY OF THE INVENTION

It is accordingly the general object of this invention to provide an improved granulator for granulating objects.

It is a further object of this invention to provide a granulator with improved means for removing the particles.

In accordance with these objects, the collection area or chamber is provided with a false bottom or channel. The channel faces downwardly and has a small clearance between its edges and the bottom to allow particles to move into the space below the channel. The channel has a larger downstream end than its upstream end.

The blower is mounted to the downstream end of the channel for creating a suction. The channel and housing bottom define a tunnel, causing high velocity air movement along the bottom of the housing. This improves the flow of particles out of the granulator.

DESCRIPTION OF THE PREFERRED EMBODIMENT

Figure 1:
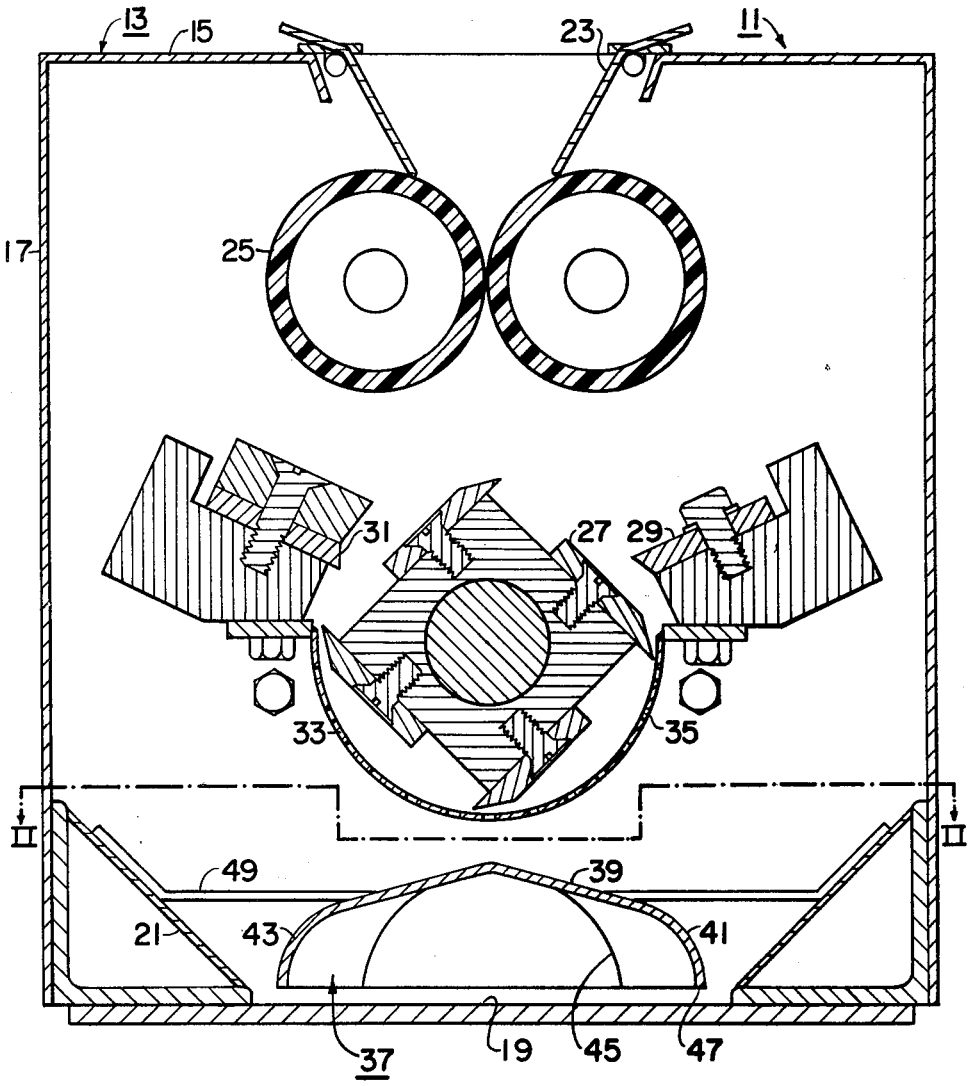
FIG. 1 is a vertical sectional view of a granulator constructed in accordance with this invention.
Figure 2:
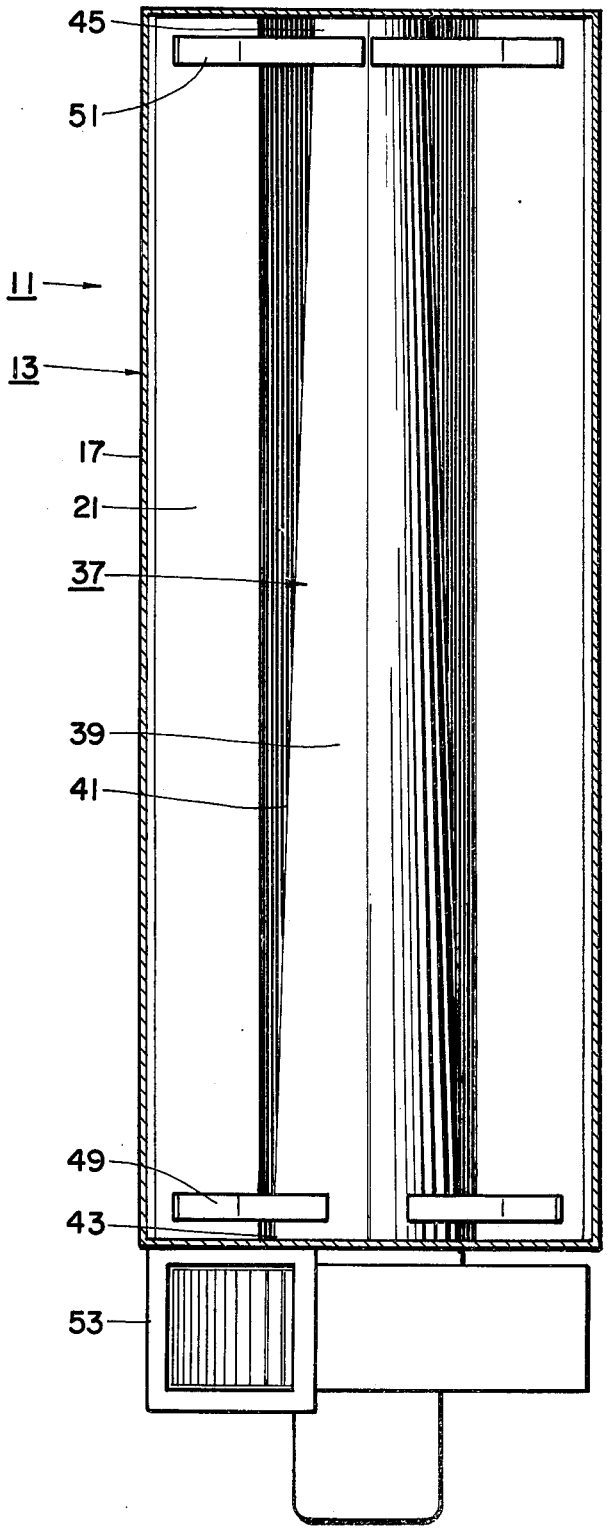
FIG. 2 is a sectional view of the granulator of FIG. 1, taken along the line II—II.

Referring to FIG. 1, a granulator 11 is shown of the type for location below a press to receive plastic sheet scrap. Granulator 11 includes a generally rectangular housing 13. Housing 13 has a flat top 15, vertical side walls 17, and a flat bottom 19. An inclined wall or partition 21 is located at the intersection of bottom 19 with side walls 17 on two sides. Each inclined wall 21 is flat and inclines at an angle of about 45° with respect to side wall 17 and bottom 19. As shown in FIG. 2, the inclined walls 21 extend the length of the housing 13.

The top 15 has an opening with a chute 23 for the insertion of articles to be granulated. A pair of rubber covered rollers 25 are mounted at the bottom of chute 23 for grasping scrap and drawing it downward. Rollers 25 are driven in opposite directions to each other and are in contact with each other.

A cutter assembly is mounted below the rollers 25 for comminuting or reducing the scrap into small particles. The cutter assembly includes a plurality of rotor knives 27. In this embodiment, there are four rotor knives 27 mounted parallel with each other and with rollers 25 in a cylindrical array. Each rotor knife 27 is a sharp edged blade extending substantially the length of housing 13, parallel with the length of inclined walls 21. In this embodiment, the rotor knives 27 are rotatably driven past two stationery bed knives 29, 31. The bed knives 29, 31 are mounted parallel with the rotor knives 27 so as to substantially meet the rotor knives 27 as the rotor knives rotate. Bed knives 29, 31 are sharp edged blades of the same length as the rotor knives 27.

A semi-cylindrical screen is mounted below the rotor knives 27. Screen 33 is perforated with a large number of holes 35 for allowing scrap particles to fall through by gravity. Screen 33 is mounted in close proximity to rotor knives 27 so that particles larger than the holes 35 will be picked up and rotated past the bed knives 29, 31 for further cutting. Screen 33 is slightly larger in diameter than the cylinder defined by rotor knives 27. The axis of screen 33 coincides with the axis of rotation of rotor knives 27.

A false bottom or channel 37 is carried below the screen 33. Channel 37 is preferably a single piece of sheet metal formed into a trough, as shown in tranverse section, and facing downwardly. Channel 37 has a peaked top 39 with a longitudinal break in its center dividing flat inclined portions. Downwardly curving sides 41 depend from the flat portions of top 39. Channel 37 extends substantially the length of housing 13 and has a longitudinal axis parallel with the axis of rotation of rotor knives 27. As shown in FIG. 2, the first or downstream end 43 is larger in width than the upstream end 45. That is, the lower edges 47 on the downstream end 43 are spaced farther apart than the lower edges 47 at the upstream end 45. In one embodiment, with a channel 37 length of 49 inches, the width at the upstream 45 is five inches, while the width at the downstream end 43 is 8.75 inches. Each side 41 intersects a line parallel to the axis of rotation of cutter knives 27 at about 4° . At the downstream end 43, the width of the channel 37 is slightly less than the distance between the lower edges of inclined walls 21, preferably leaving about one-half inch clearance on each side.

A pair of brackets 49 are rigidly secured to the top 39 of channel 37 at the downstream end 43. As shown in FIG. 2, a second pair of brackets 51 are secured to the top 39 of channel 37 at the upstream end 45. Brackets 49, 51 are metal strips bent between the ends, with the outer ends resting loosely on inclined walls 21. The nonrigid mounting allows vibration of the channel 37. Brackets 49, 51 are formed to support channel 37 horizontally, with its lower edges 47 a uniform selected distance above the housing bottom 19. The clearance must be sufficiently large to allow particles to move under the edges 47 into the space below channel 37. In the preferred embodiment, the clearance is about one-half inch.

Referring to FIG. 2, a conventional impeller blower 53 is mounted to housing 13 with its intake in the downstream end 43 of channel 37. Blower 53 is driven by a motor to create a suction, to cause air movement from the small upstream end 45 to the large downstream end 43. The clearance between the housing bottom 19 and the channel edges 47 should be sufficiently small so as to create an appreciable air movement along the length of the channel 37.

In operation, flat scrap material such as plastic or the like is fed into chute 23 and drawn by rollers 25 into the cutter assembly. The scrap is cut repeatedly by the rotor knives 27 until the particles fall through holes 35. The particles fall onto the top of channel 39 and onto inclined walls 21. Blower 53 draws air along the bottom of housing 19 under channel 37. An air current is also created that moves downwardly under edges 47. Vibration due to the cutter assembly motor and blowers aids the air movement in causing the particles to move off the top of channel 39 and down into the space below channel 37. Channel 37 and bottom 19 define a tunnel wherein the air velocity is higher than on the outside, causing movement toward blower 53. The particles move through the blower 53 and are conveyed by a conduit to a bin for melting and reuse. The smaller upstream end 45 constricts the flow path to increase the velocity at the end opposite the blower.

It should be apparent that an invention having significant advantages has been provided. The channel in the collection chamber increases air velocity, allowing more effective particle removal. A considerably smaller blower will convey more particles than a larger blower in a system without a channel. This allows a quieter and more efficient granulator.

While the invention has been shown in only one of its forms, it should be apparent to those skilled in the art that it is not so limited but is susceptible to various changes and modifications without departing from the spirit thereof.

I claim:

1. In a granulator of the type having a housing, a cutter assembly located in the housing for granulating objects into particles, and a blower for removing the particles from the bottom of the housing, the improvement comprising:

a false bottom carried between the cutter assembly and the bottom of the housing, with spaces being between the bottom of the housing and the edges of the false bottom for the admission of particles to the space below the false bottom, the blower being positioned at one end of the false bottom to cause air movement along the length of the housing bottom between the housing bottom and the false bottom.

2. The granulator according to claim 1 wherein the false bottom comprises a downwardly facing channel.

3. The granulator according to claim 2 wherein the channel is larger in width on one end than on the other end.

4. The granulator according to claim 3 wherein the blower is mounted to the larger end of the channel and rotated for creating a suction.

5. In a granulator of the type having a housing, a cutter assembly located in the housing for granulating objects into particles, the housing having a bottom for collecting the particles, and a blower for removing the particles from the bottom of the housing, the improvement comprising:

a downwardly facing channel carried between the cutter assembly and the bottom of the housing, the channel having edges spaced from the bottom of the housing to allow the admission of particles into the space below the channel, the channel having one end larger in width than the other end, the blower being connected to the larger end for creating suction to draw the particles along the bottom below the channel and out of the housing.

6. The granulator according to claim 5 wherein the channel is carried loosely in the housing to allow vibration of the channel to facilitate movement of particles from the top of the channel to the space below the channel.

7. The granulator according to claim 5 wherein the channel has a peaked top and downwardly curved sides.

8. In a granulator of the type having a housing, a cutter assembly located in the housing for granulating objects into particles, the cutter assembly having a plurality of rotor knives rotated past a stationary knife for cutting the articles, and a perforated screen mounted below the rotor knives with apertures therethrough that allow the particles to fall through for collection, and a blower for removing particles from the housing, the housing having inclined walls below the cutter assembly and a bottom for collecting the particles, the improvement comprising:

a downwardly facing channel carried loosely below the screen and between the inclined walls by brackets, the channel having a longitudinal axis parallel with the axis of rotation of the rotor knives, the channel having two spaced apart edges spaced a selected distance from the bottom of the housing to allow particles to enter the space below the channel, the edges of the channel on a first end being spaced farther apart from each other than the edges on the second end, the blower being connected to the first end for creating a suction to draw the particles along the bottom below the channel and out of the housing.

* * * * *